United States Patent [19]

Viitanen et al.

[11] Patent Number: 4,502,361

[45] Date of Patent: Mar. 5, 1985

[54] METHOD AND APPARATUS FOR DYNAMIC REPRODUCTION OF TRANSIENT AND STEADY STATE VOICES IN AN ELECTRONIC MUSICAL INSTRUMENT

[75] Inventors: Jouko O. Viitanen, Tavastia, Finland; John T. Whitefield, Harleysville, Pa.

[73] Assignee: Allen Organ Company, Macungie, Pa.

[21] Appl. No.: 559,585

[22] Filed: Dec. 8, 1983

[51] Int. Cl.[3] ..... G10H 1/02; G10H 7/00

[52] U.S. Cl. ..... 84/1.26; 84/1.13

[58] Field of Search ..... 84/1.13, 1.26

[56] References Cited

U.S. PATENT DOCUMENTS 4,184,403 1/1980 Whitefield ..... 84/1.26 X 4,352,312 10/1982 Whitefield et al. ..... 84/1.26 X

*Primary Examiner*—Stanley J. Witkowski

*Attorney, Agent, or Firm*—Sanford J. Piltch

[57] ABSTRACT

A method and apparatus for reproducing the complete attack transient and steady state portions of a waveform is disclosed. In an electronic musical instrument providing a means for detecting the depression and release of a key switch, a means for storing a complete attack transient of the waveform and a predetermined number of full cycles of the steady state of the waveform, a means for generating addresses for selectively causing the reading from the storage means the complete attack transient of the waveform and the predetermined number of full cycles of the steady state of the waveform and for generating addresses for selectively causing the repeated reading from the storage means, either randomly or in a predetermined pattern, a number of cycles of the steady state of the waveform until release of the depressed key switch, and means for generating addresses for selectively causing the continued repeated reading from a storage means, either randomly or in a predetermined pattern, a number of cycles of the steady state of the waveform during the decay transient of the waveform until audio ceases. The waveform contains envelope characteristics and is of an harmonically and non-harmonically varying content changing with time. Upon the detection of the completion of the reading of the complete waveform the continued depression of the key switch a number of cycles of the steady state of the waveform are continued to be read from the storage means, either randomly or in a predetermined pattern, until release of the depressed key switch. The repeated reading of the number of cycles is a recirculation of the steady state portion of the waveform and is controlled by a switch means which limits the generated address to a predetermined address or the randomly generated addresses to a predetermined range. The amount of recirculation of the steady state portion of the waveform may also be controlled by incorporating the voice memory data of the first address location of the first cycle of the attack transient portion of the waveform a digital coding limiting the randomly generated addresses to a predetermined range.

28 Claims, 6 Drawing Figures

METHOD AND APPARATUS FOR DYNAMIC REPRODUCTION OF TRANSIENT AND STEADY STATE VOICES IN AN ELECTRONIC MUSICAL INSTRUMENT

BACKGROUND OF THE INVENTION

Harmonic change occurs in most, if not all, musical instruments in varying degrees as they are played. The harmonic change in the resulting tone of the musical instrument noticeably varies with time. Many instruments exhibit this change during the onset of tonal reproduction followed by the settling down of the tone, harmonically, to what is commonly referred to as a steady state condition. Some examples of the types of instruments which exhibit such harmonic change with time include horns, bowed strings, and organ pipes. The onset or attack transients associated with an organ pipe can be very pronounced, often sounding like tuned wind or noise. In synthesizing or reproducing the sound of such instruments electronically, harmonic change with time is an important contribution to realism.

In prior electronic musical instruments, harmonic variations with time have been implemented with varying degrees of success. One attempt is described in U.S. Pat. No. 4,184,403, assigned to the assignee of the present invention, in which waveform generation is accomplished by successively and repeatedly reading out amplitude samples of a waveform stored in memory as full or half cycle representations of the waveform. The harmonic content of the voice or tone being generated is caused to change by reading from multiple memories singly but in sequence, where each memory contains a slightly different harmonic content.

An improved method of generating more accurate reproductions of the transient portions of a waveform is described in U.S. Pat. No. 4,352,312, also assigned to the assignee of the present invention. This improved method causes an interpolation between the various different harmonic structures yielding a very smooth and gradual change from one harmonic structure to another during the transient periods of the waveform. One of the major deficiencies with the foregoing methods is the arduous task of accurately determining the harmonic composition of the transient portion of the waveform at a given point in time coupled with an inherent inability of the circuitry of the electronic musical instrument to reproduce non-harmonic components of the waveform.

One such attempt at recreating a natural sound is described in U.S. Pat. No. 4,383,462. The patent describes the use of storing wave shapes in memory and retrieving them in accordance with the teachings of U.S. Pat. No. 3,515,792. While a "tone wave shape" of the attack period, for instance, may be stored in memory, the envelope characteristics are still generated separately before storing them in memory. A "complete wave shape" is a combination of the "tone wave shape" with its corresponding envelope added to it. Thus, the system perpetrates the deficiency of not being able to recreate the harmonic and non-harmonic content of the waveform because the wave shape and envelope are created separately before they are added together and stored in memory. The remaining portions of the wave form, the steady state and decay periods, are recreated from standard wave shapes and a separate envelope generator in accordance with current practice. This system provides little insight into overcoming the stated deficiencies and in some respects perpetrates them.

It is therefore an object of the present invention to eliminate the disadvantages stated above by providing a sufficiently large memory to store and retrieve the complete attack transient portions of the waveform and some number of cycles of the steady state portion of the waveform, both stored as contiguous amplitude samples, along with the proper memory read control circuitry.

It is also an object of the invention to provide the capability to reproduce the non-harmonic components of the waveform throughout its entire structure.

It is a further object of the present invention to provide a means for recirculating one or more of the steady state cycles of the waveform in order to create a sustained tone while the actuating key of the electronic musical instrument remains depressed.

Other objects will appear hereinafter.

SUMMARY OF THE INVENTION

These objectives may be achieved by expanding the voice memory addressing circuitry beyond that which is required to address a single period, thus causing the reading out of some number of contiguous waveform periods where the harmonic content of each period may be different. While reference is made to the storing of some number of periods or cycles, it may, in fact, be that at the very beginning of the transient portion of the waveform periodicity may be hard to define. In such case it may be better to think of the method of the present invention as one of storing the transient phenomenon for a period of time equal to some number of periods of the steady state portion of the waveform. period may be different. While reference is made to the storing of some number of periods or cycles, it may, in fact, be that at the very beginning of the transient portion of the waveform periodicity may be hard to define. In such case it may be better to think of the method of the present invention as one of storing the transient phenomenon for a period of time equal to some number of periods of the steady state portion of the waveform.

On the depression of a key, the outputs of the note generator, having as its final stage a voice sample address generator, and the voice period address generator are reset to an all "0" state. From this initialization state the address generators count upward over their respective ranges. The voice period address generator provides a higher order address to the voice memory than the voice sample address generator. After addressing a preselected number of samples equal to a single period of the steady state of the desired waveform by the voice sample address generator, the higher order voice period address generator advances one count. This process continues until the voice period address generator has reached its maximum count. Once the maximum count of the voice period address generator is reached, the complete attack transient waveforms has been read from the voice memory along with some number of cycles of the steady state waveform of the selected voice. In order to continue sounding or reproducing the tone, if the associated key of the keyboard remains depressed, the voice period address generator is set to some integer number of periods less than its full count so that the voice memory data associated with the higher order periods may be repeated again. As long as the note generator associated with the depressed key remains claimed, some number of steady state waveform periods will be repeated and the tone reproduced through the audio system. On the release of the associated key, the output of an attack/decay processor, which had abruptly risen to full value on initial key depression allowing the attack envelope to be generated, will begin to decrease in a specified manner until audible sound ceases. The attack envelope is contained intrinsically to the stored attack transient portion of the waveform.

During the time in which the associated key of the keyboard remains depressed after the conclusion of the attack transient period, which will be referred to hereinafter as the steady state recirculating period, the point to which the voice period address returns can be fixed or random. In the fixed mode the voice period address may be set to repeat the last period only, or return a specified number of periods and count to its maximum. The recirculating period can also be made to return a random number of periods and count to the maximum. A modification to the random return count is to return a random number of periods and count through a single period only and randomly shift to another point, either forward or backward, and count through a second single period. In the random shifting modes an interesting wind-like noise is produced which can add to the realism as in speaking pipes which produce such a wind noise even during sustained play.

The present invention functions to reproduce the complete attack transient and steady state portions of a waveform. In an electronic musical instrument having a greater number of selectively actuable key switches than tone generators to cause the production of sounds corresponding to the notes in a musical scale wherein an apparatus, consistent with the present invention for reproducing the complete attack transient and steady state portions of a waveform, comprises means for detecting the depression or release of a key switch, means for storing a complete attack transient of a waveform and a predetermined number of full cycles of the steady state of the waveform wherein said waveform contains envelope characteristics and varies both its harmonic and non-harmonic content with time. Addresses are generated for selectively causing the reading from the storage means the complete attack transient of the waveform and the predetermined number of fully cycles of the steady state of the waveform. Addresses are also generated for selectively causing the repeated reading from the storage means, either randomly or in a predetermined pattern, a number of cycles of the steady state of said waveform until release of the depressed key switch. Addresses are further generated for selectively causing the continued repeated reading from the storage means, either randomly or in a predetermined pattern, a number of cycles of the steady state of the waveform during the decay transient of the waveform until audio ceases.

The generated addresses cause the selective reading from the storage means of each cycle or period of the attack transient of the waveform and each cycle or period of the steady state of the waveform. Each cycle or period of the waveform is comprised of a group of amplitude samples obtained from a recording and analysis of the actual instrument sound being reproduced.

A means for detecting the completion of the reading of the complete waveform and the continued depression of the key switch triggers the generating of addresses for selectively causing the continued reading from the storage means, either randomly or in a predetermined pattern, a number of cycles of the steady state of the waveform until release of the depressed key switch. The repeated reading of the number of cycles being a recirculation of the steady state portion of the waveform. The amount of recirculation of the steady state portion of the waveform is controlled in several manners. The first being the setting of switch means for limiting the generated addresses to a predetermined address. The second being the setting of the switch means for limiting the randomly generated addresses to a predetermined range. The final method of controlling the amount of recirculation of the steady state portion of the waveform is accomplished by incorporating in the voice memory data located in the first addressed amplitude sample of the first cycle of the attack transient portion of the waveform a digital code for limiting the randomly generated addresses to a predetermined range.

An attack/decay processing means is used for generating envelope amplitudes for the selected waveforms in response to a signal having a value indicative of an attack or a decay. The envelope amplitude abruptly goes to full scale on the occurrence of a signal having a value indicative of an attack to allow the stored attack transient of the waveform containing the envelope characteristics to be read out without limitation. On the occurrence of the signal having a value indicative of decay the envelope amplitude is generated in a predetermined pattern according to the envelope characteristics previously stored in memory.

Additionally, a means for storing a complete decay transient of a waveform and for generating addresses for selectively causing the reading form the storage means the complete decay transient of the waveform until audio ceases is disclosed.

BRIEF DESCRIPTION OF THE DRAWINGS

For the purposes of illustrating the invention, there are shown in the drawings forms which are presently preferred; it being understood, however, that the invention is not limited to the precise arrangements and instrumentalities shown.

DETAILED DESCRIPTION OF THE PREFERRED EMBODIMENTS OF THE INVENTION

The following detailed description is of the best presently contemplated modes of carrying out the present invention. This description is not intended in a limiting sense but is made solely for the purpose of illustrating the general principles of the invention.

Figure 1:
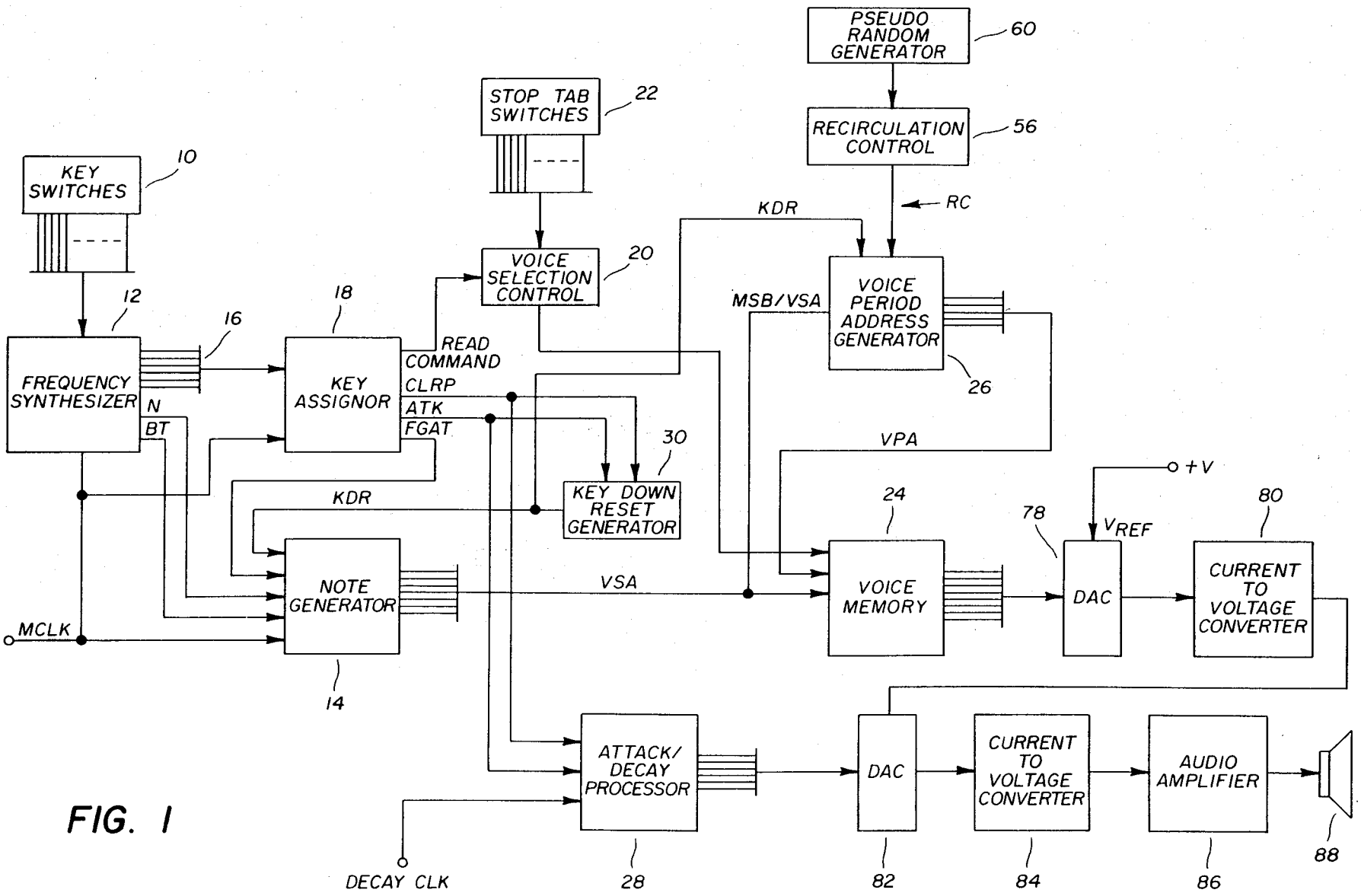
FIG. 1 is a schematic diagram, in the form of a block diagram, of an electronic musical instrument embodying an apparatus for dynamically reproducing the transient and steady state portions of the selected waveform in accordance with a first embodiment of the present invention.

Referring now to the drawings in detail, wherein like numerals indicate like elements, there is shown in FIG. 1 a schematic, in block diagram form, of an electronic musical instrument in accordance with the first embodiment of the present invention. An electronic musical instrument or digital electronic musical instrument in which the present invention may be applied and used is described in detail in U.S. Pat. Nos. 3,610,799 and 3,639,913 which are assigned to the assignee of the present invention. Reference may be had to these patents for detailed descriptions of the components referred to herein other than the instant invention producing structural relationships in accordance with the invention. In addition, the attack/decay processor of the present invention as it relates to frequency synthesization and key assignment logic is described in U.S. Pat. No. 3,610,805 which is also assigned to the assignee of the present invention. Reference may also be had to this patent for detailed descriptions of components referred to herein other than the instant invention producing similar structural relationships in accordance with the invention.

In FIG. 1, there is shown a set of keys or key switches 10 making up the keyboard of the electronic musical instrument. The key switches 10 are used in the generic sense and will be referred to herein as keys, being the keys of various electronic musical instruments. The activity of the key, the actuation or depression and release thereof, is encoded in a time-division multiplexed format in accordance with the teachings of U.S. Pat. No. 3,610,799. The time-division multiplexed signal proceeds to a frequency synthesizer 12 which generates a frequency number N corresponding to the actuated key. The frequency number N is generated in a serial format and proceeds to note generator 14. Note generator 14 denotes a number of note generators in accordance with the teachings of the previously mentioned patent. However, it is to be understood that the number of note generators could be greater in number or limited to one if only a single note is required to sound at a time.

The frequency synthesizer 12 also generates a timing pulse, BT, which is used for internal timing functions in the note generators. The internal timing functions in the note generators refer to the 12 μsec time slots allotted to each multiplexed channel, each channel corresponding to a note generator. Frequency synthesizer 12 also supplies keyboard division, octave and note information along lines 16 to the key assigner 18. Key assigner 18 generates a claiming pulse, FGAT, for claiming any one of the note generators in note generator 14 in accordance with the internal timing functions. Frequency synthesizer 12, note generator 14, and key assigner 18 are each controlled by a master system clock, MCLK. For a more detailed explanation of the interrelationship of these devices, reference should be made to the above-listed patents and U.S. Pat. No. 4,352,312 which are incorporated herein by reference.

The final stage of note generator 14, the voice sample address generator, generates an address which is transmitted to the voice memory 24 to provide the correct memory location to be read out within the multiplexing scheme of the keyboard musical instrument. An appropriately chosen output line of the voice sample address generator is used for control of the voice period address generator 26 which will be described more fully hereinafter.

Concurrently, with the generating of the voice sample address from generator 14, the key assigner 18 generates a read command to the voice selection control 20. The voice selection control 20 senses which of the stop tab switches 22 are selected and generates an address to voice memory 24 which designates the memory locations of a specific voice or voices in accordance with the setting of the stop tab switches 22. The memory address from the voice selection control 20 is generated simultaneously with the voice sample address from the note generator 14 and the voice period address from generator 26. In this manner, which is in accordance with the teachings of the previously referenced patents, the information from the desired memory locations may be read out of the voice memory 24.

The key assigner 18 also generates additional signals. These are a clear pulse signal, CLRP, and an attack transient detection signal, ATK. These signals provide control for the attack/decay processor 28 and the key down reset generator 30 and will be described more fully in relation to the description of these elements hereinafter.

The key down reset generator 30 consists of a single AND gate having as its input the CLRP and ATK signals. A key down reset signal, KDR, results when CLRP and ATK occur simultaneously in the multiplexed scheme in association with a newly claimed tone generator of generator 14. The reader should note that the ATK signal appears only when a key depression has been detected. The CLRP signal occurs not only on key depression but also on key release. In the present invention, which has the attack transient portion of the waveform incorporated into the voice memory 24, it becomes necessary to continue addressing that portion of voice memory 24 containing the steady state waveform after key release. Thus, the CLRP generated on key release is excluded from the address generators 14 and 26 so that a reset of the counters will occur only on the occurrence of a key depression. This enables the steady state portion of the waveform to continue through its periodic recycling during the decay portion of the reproduced sound. This decay portion is controlled by the attack/decay processor 28 which will be described more fully hereinafter.

The effect of the KDR signal on note generator 14 is to reset all of the outputs of its final stage, the voice sample address generator, to the "0" state on the detection of a key depression. The KDR signal is also applied to the voice period address generator 26 to cause all of its outputs to also be reset to a "0" state. The "0" address condition of the voice sample and voice period address generators 14 and 26 are applied to the voice memory 24 which will, in response thereto, begin to read out the previously deposited waveform information corresponding to the beginning of the transient portion of the waveform. This information or voice memory data is the very first sample of the transient portion of the waveform and, after conversion, has an equivalent value near zero. The voice sample address generator 14 will then begin to count or advance at a rate proportional to the frequency number received from frequency synthesizer 12 which is directly related to the particular key which has been depressed. As the voice sample addressing continues, the resulting data from the voice memory 24 will be read out as sequential amplitude samples representing the character of the transient portion of the waveform. When the voice sample address generator reaches its maximum count, the equivalent of a single period of the steady state portion of the waveform will have been read from the voice memory 24. Since it is only the beginning of the transient portion of the waveform, the converted output is not likely to be recognizable as a periodic signal. A representative maximum count is 128 but may be any number of counts depending only upon the nature of the waveform to be synthesized, the machine structure and the designer's requirements.

The address to the voice memory 24 is comprised of three separate components. The voice sample address component consists of, in this preferred embodiment, seven address lines. It should be understood that the number of address lines is the choice of the designer and should not be construed as limiting the invention. The voice sample address portion comprises the lowest order bits of the entire address to the voice memory 24. The next higher order bits of the address is that of the voice period address generator 26 which consists of, in this preferred embodiment, five address lines. Again, this is the choice of the designer and should not be construed as limiting the invention. The voice period address generator will count through thirty-two periods or cycles of the waveform before beginning recount sequence. The highest order bits of the address to the voice memory 24 are comprised of the voice selection address lines from the voice selection control 20 and will vary in number depending upon the number of voices which are selectable in any given electronic musical instrument and the number of input address lines to the memory section for such instrument.

The voice period address generator operates so as to advance one count each time the last stage of the note generator 14, the voice sample address generator, counts through its entire 128 counts. This operation is repeated until the voice period address generator 26 reaches its maximum count of 32. Thus, each advance of the voice period address generator 26 represents the ultimate formation of a new period or cycle of the selected tone or waveform. When the voice period address generator 26 reaches its full count, the last amplitude sample of the last period or cycle of the waveform has been generated.

The voice waveform information or data to be read out of the voice memory 24 in the foregoing described sequence is obtained using existing technology and commercially available instrumentation. The information gathering process, as such process relates to an electronic organ, begins by exciting the subject pipe through the use of a motor driven blower. The audible response from the pipe is picked up by a condenser-type or other good quality microphone, passed through an audio amplifying system and presented to a sound analysis system such as, the Synclavier II, manufactured by the New England Digital Corporation. The Synclavier II is comprised of an analog-to-digital converter, an expansive memory for storing the digital representation of the sound to be analyzed, in this case the transient phenomenon of an organ pipe, and a computer for analyzing the acquired information for purposes of determining the points at which the stored information becomes periodic. Determining the point in time where periodicity begins is necessary for defining the steady state portion of the waveform. The analyzed information, as sampled amplitudes, is then transferred to a read-only memory, ROM, in such a way that, based on the cycles or period of the waveform, zero crossings or near zero crossings of the waveform in the steady state portion of the waveform fall at each cycle or period boundary of the addressing scheme. This procedure is required in order that the recirculation process for sustaining the tone be carried out without incurring objectional noises which would detract from the reproduced sound.

The quantity of information which must be stored in order to yield an acceptable result depends upon the region of the keyboard which is associated with the reproduced sound. If one assumes that the highest frequency to be reproduced is 16 KHz, then according to the sampling theorem, the sampling rate must be at least 32 KHz. At this sampling frequency a tone whose fundamental frequency was 261 Hz, middle C, would require 122.6 samples per period; where $f_F$ is the fundamental frequency, $P_F$ is the period of the fundamental frequency, $f_s$ is the sampling frequency, and $P_s$ is the sampling period:

$f_F = 261$ Hz $P_F = 1/f_F = 3.83 \times 10^{-3}$ $f_s = 32$ KHz $P_{s(C\text{-}3)} = 1/f_s = 3.125 \times 10^{-5}$ Sampling Rate $= P_F/P_s = 122.56$ samples/period.

Therefore, a sampling rate of 128 would be satisfactory.

For a tone whose fundamental frequency is one octave lower, C-2, the required sampling rate would have to be doubled.

$f_F = 130.5$ Hz $P_F = 1/f_F = 7.66 \times 10^{-3}$ $P_{s(C\text{-}2)} = 1/f_s = 3.125 \times 10^{-5}$ Sampling rate $= P_F/P_s = 245.12$ Thus a sampling rate of 256 would be an acceptable rate for reproducing the selected frequency of sound.

Other factors which play an important part in determining the quantity of information which must be stored are the harmonic content of the analyzed voice and factors relative to the sampling rate of the equipment used for analysis. It has been found, for example, that a Principal pipe speaking at a C-3 pitch (approximately 261 Hz) can be contained or stored in a 4K byte memory where the equivalent of thirty-two periods have been sampled at the rate of 128 samples per period. Thus, the number of amplitude samples actually stored equals 4,096 sampled amplitudes which may be stored in any commercially available programmable read only memory, PROM. The preferred storage is in a 2764 EPROM (erasable programmable read only memory) which is available from most commercial integrated circuit manufacturers.

By organization of the voice memory data, the amplitude samples at the beginning and end of a waveform cycle have a zero or near zero value as may be determined by an analog conversion of the waveform. Analysis of many cycles of the steady state portion of the waveform exhibit that a truly periodic waveform has been generated unlike the transient portion at the beginning of the waveform which changes character drastically from period to period.

As the voice period address generator reaches its full count, certain special treatment is needed if the key remains depressed. Without such special treatment, upon receipt of the next advance command from the voice sample address generator of generator 14, both generator 14 and voice period address generator 26 would roll over and begin counting from zero. This would result in a repeat of the total transient phenomenon which is not desired and is not the expected occurrence with a key being held depressed. Therefore, when the key remains depressed and the voice period address generator has reached its full count, on receipt of the next advance command the voice period address generator is preset, not to all zero's as it would be if it rolled over, but to a value less than or equal to its full count but greater than an address corresponding to the first period of the waveform representing the steady state portion thereof. If the preset address were to precede the first steady state period, noise would result due to the abrupt change in the character of the waveform.

Figure 2:
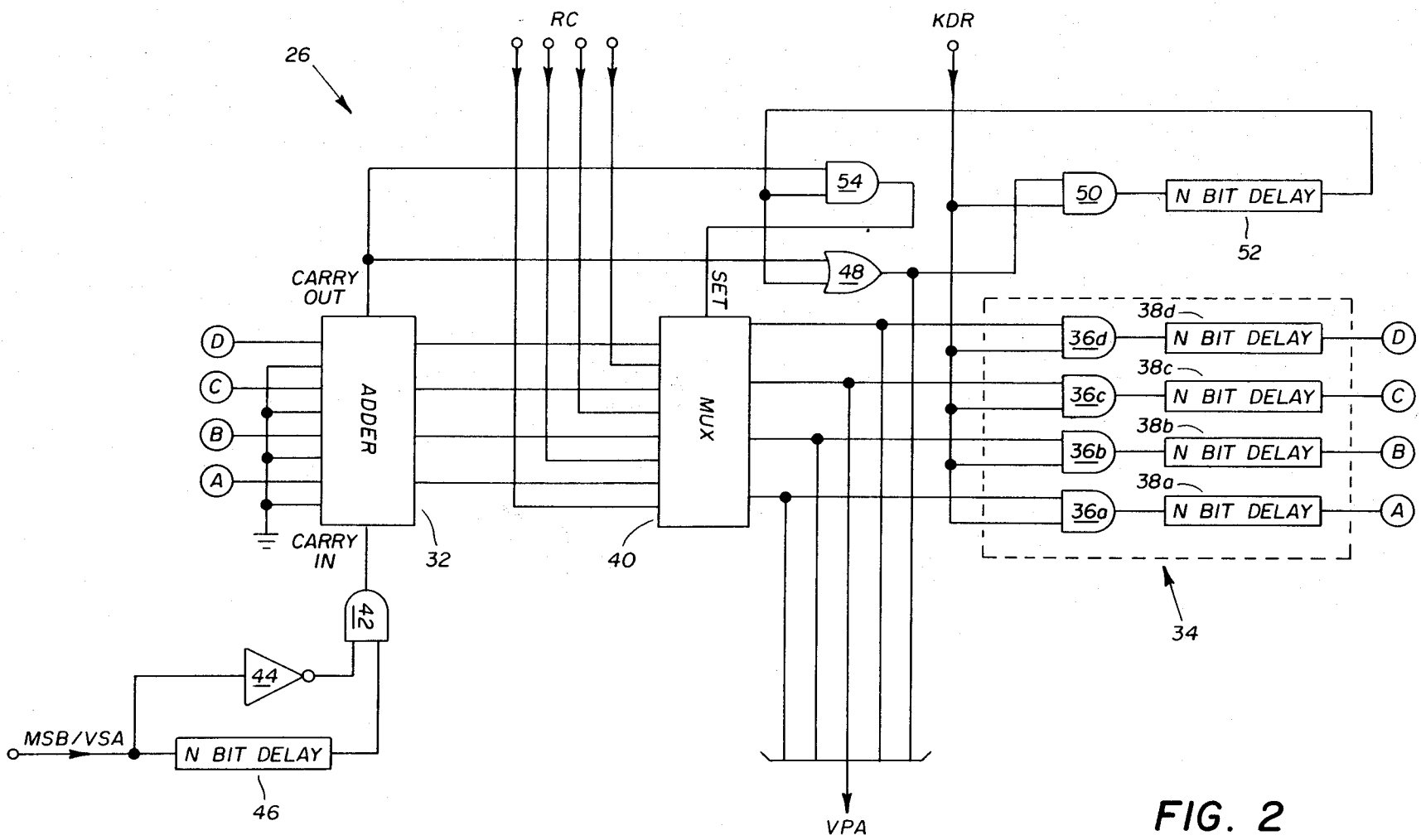
FIG. 2 is a block and logic diagram of the voice period address generator of the first embodiment of the present invention.

Referring now to FIG. 2, the first embodiment of the invention has a voice period address generator 26 which is comprised of the following elements. An arithmetic unit or adder 32 in combination with shift register 34 form a basic modulo 16 by n multiplexed counter. The shift register 34 is comprised of AND gates 36*a*–36*d* and by 1×n bit delay elements 38*a*–38*d*, where n equals the number of tone generators. Each of these dalay elements is preferably 1×12 bit delay element in accordance with the teaching of the aforementioned related patents. The AND gates 36*a*–36*d* have been inserted in the circuit before the delay elements 38*a*–38*d*, respectively, to enable the resetting of the voice period address generator 26 on the occurrence of a KDR signal. Further, a multiplexer 40 has also been inserted in the circuit to enable the presetting of the counter which will be discussed more fully hereinafter. Thus, the adder 32, the shift register 34 and the multiplexer 40 form the recirculating counter of the voice period address generator 26 having, for this embodiment, a preferred output address containing five lines and referred to as a voice period address.

The counter portion of the voice period address generator 26 is advanced by the output of AND gate 42, which output is the carry in input of adder 32. The AND gate 42 in conjunction with inverter 44 and delay element 46 provide a carry out function from the voice sample address portion of the note generator 14. Thus, on the first occurrence of a "0" on the most significant address line of the voice sample address, a pulse will occur at the output of AND gate 42.

When the adder 32 of the recirculating counter portion of the voice period address generator 26 reaches its maximum count and receives an advance signal on its carry in input from AND gate 42, all of its outputs will become "0" and an output will be generated on the carry out output of adder 32. The carry out will cause the recirculating latch formed by OR gate 48, AND gate 50 and 1×n bit delay element 52 to change from "0" to "1" signifying the midpoint in the total voice period address count. As the recirculating counter portion of voice period address generator 26 once again counts from "0" to its maximum, the second half of the selected waveform stored in voice memory 24 will be read out ending with some number of steady state periods. On receipt of the next advance command from the voice sample address portion of note generator 14, the address lines of voice sample address generator 14 and voice period address generator 26 will both roll over to an all "0" state. At the same time a carry out signal from adder 32 will once again be generated. This carry out signal in conjunction with the "1" existing in the recirculating loop from delay element 52 will generate a "1" at the output of AND gate 54 which creates a set pulse to multiplexer 40. This set pulse causes the multiplexer to transfer the preset address value, RC, from the recirculation control 56 to its outputs and apply the preset value to the shift register 34 for as long as the set signal is maintained. This new address will be latched in shift register 34 to be recirculated through the adder 32 and advanced to the maximum count repeating the reading out of selected portions of the waveform from voice memory 24.

Figure 3:
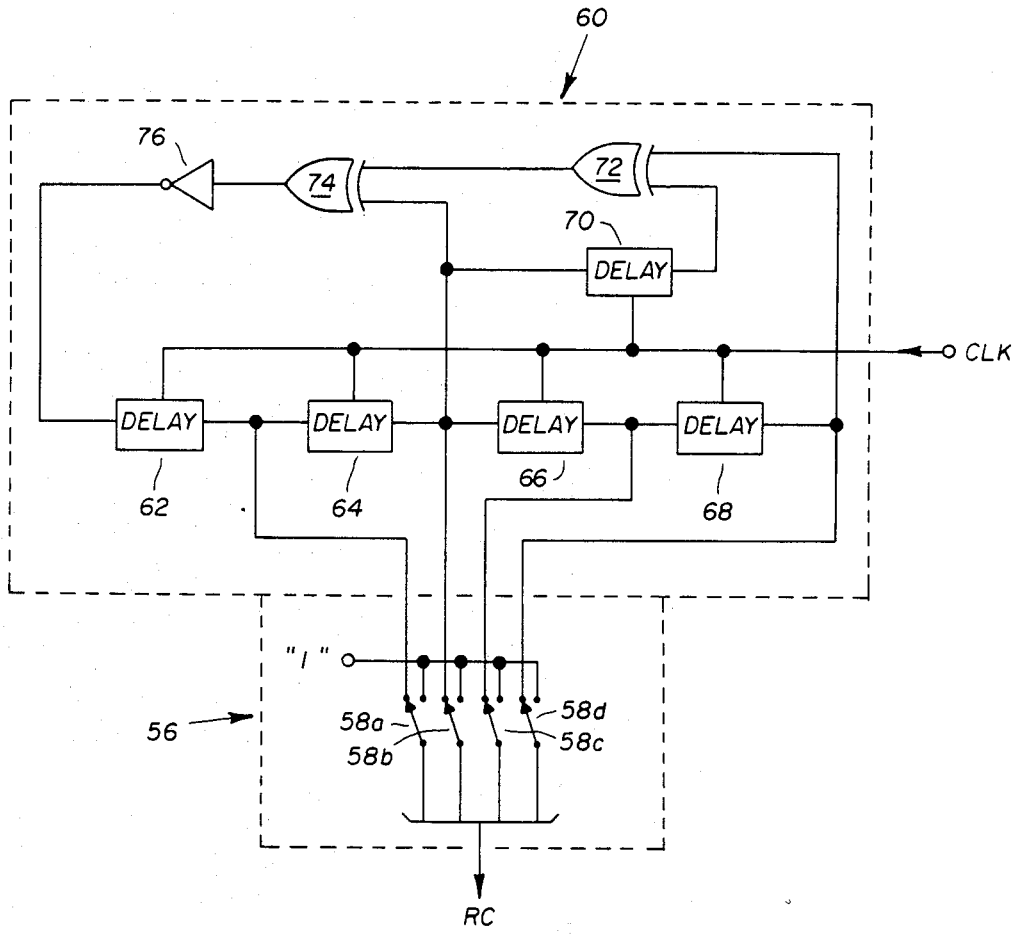
FIG. 3 is a block and logic diagram of the pseudo-random generator and recirculation control means of the first embodiment of the present invention.

The source of the preset address is the set of switches 58*a*–58*d* (recirculation control 56) in conjunction with the pseudo-random generator 60 as shown in FIG. 3. The pseudo-random generator is familiar to those skilled in the art and the circuit shown is one normally used for producing random digital numbers. The circuit is comprised of delay elements 62, 64 and 66, each having a delay count of 4. Delay elements 68 and 70, each having a delay count of 5 and 1, respectively. Each of the delay elements 62–70 use as their timing base a common clock source (not shown). The pseudo-random generator circuit is completed by connecting the outputs of delay elements 68 and 70 through exclusive OR gate 72 which in turn is connected to exclusive OR gate 74 which has as its other input the output of delay element 64. The output of exclusive OR gate 74 is inverted through inverter 76 and applied to the input of delay element 62. Each of the delay elements 62, 64, 66 and 68 are interconnected output to input as is readily apparent from the drawing. Additionally, the output of delay element 64 is connected to the input of delay element 70. The outputs of each of the delay elements 62–68 are connected to one of the inputs of switches 58*a*–58*d*, respectively. The second of the inputs to the switches 58*a*–58*d* is connected to a digital "1" as will be explained immediately following.

The switches 58*a*–58*d* are shown as the recirculation control as an expedient for exhibiting the capability of the present invention. The switches would not be available to the user of the electronic musical instrument and would be preset to pass either the all "1" value or the value from the four lines of the pseudo-random generator 60.

If all four switches 58*a*–58*d* are connected to the four output lines of the pseudo-random generator 60, the preset address to the voice period address generator 26 would vary between all "1's" and all "0's" for a total of sixteen different addresses . Another way to look at this is that the recirculation could go as far back into the waveform stored in voice memory 24 as the half way point. An alternative situation would be for the switches 58*a*–58*d* to be connected to the "1" value which would lock the preset address to all "1's" and the recirculation would include only the last period of the waveform. Any other combination of switch settings would apply differing limits on the number of periods of the recirculated waveform. Of course, all references to specific numbers with regard to address lengths or shift register lengths are purely arbitrary and could be any number consistent with the desired result.

Thus the recirculation control signal, RC, on the four output lines from the recirculation control 56 as applied to the multiplexer 40 of the voice period address generator 26 would cause a return to either the last period of the waveform stored in voice memory 24 or any prior period of the waveform as far back as the halfway point of the stored waveform. Once the starting point for the recirculation has been applied to the multiplexer 40 then the voice period address generator 26 will count from that point to its maximum for as long as the associated key is held depressed. The set signal to multiplexer 40 will be released allowing the output from adder 32 to once again be applied to the shift register 34 where the new count recirculates until the next carry-in signal from AND gate is applied to the adder 32. If the voice period address generator 26 reaches its maximum and the key remains depressed, then the process will be repeated again until the key is released.

While the capability to recirculate back to the halfway point is a possibility, it is not always desirable. The waveform stored in the voice memory 24 encompasses the entire transient and then some number of steady state periods of that waveform. In most circumstances the transient occupies more than half of the voice information data stored in the memory 24 and thus the pseudo-random generator may be limited such that upon recirculation only the steady state portion of the waveform or the steady state portion and a limited number of periods at the final transition of the transient portion of the waveform may be usable to create the desired steady state tone of the selected voice.

Returning to FIG. 1, the output of the voice memory 24 is applied to a digital to analog converter 78 which is a multiplying digital to analog converter similar to Analog Devices AD7523. The outputs of such devices have currents which are proportional to the product of its digital input code and its analog reference voltage. The supply voltage to the reference voltage input of the digital to analog converting devices has been chosen in accordance with the manufacturer's recommendations of a range between +10 V. and −10 V. It is preferred that the supply voltage +V be in the range of +5 V. to plus 10 V. The output of DAC 78 as converted by current to voltage converter 80 is used as the voltage reference input to DAC 82 which is similar in structure and configuration to the DAC 78. DAC 82 uses as its digital code input the output of the attack/decay processor 28 which serves a similar purpose to the attack-/decay envelope shaping memory described in U.S. Pat. No. 4,352,312 which is incorporated herein by reference. The differences between the prior disclosure and the present invention are that attack/dacay processor 28 contains only decay envelope shaping characteristics and is controlled by a single rate source, the decay clock signal. This is because the attack envelope characteristics are contained as a part of the data obtained from the recorded pipe and included in the voice information data stored in the voice memory 24. Thus, unlike other electronic tone generation methods, the attack envelope characteristics are no longer necessary to be contained within the processor 28. Thus, the attack-/decay processor 28, upon received CLRP and ATK signals, abruptly goes to full scale and holds there until the ATK signal changes from its "1" value to a "0" value indicating the beginning of the decay portion of the waveform. The decay is then synthesized in accordance with the teachings of U.S. Pat No. 4,352,312 through the DAC 82, the current to voltage converter 84, the audio amplifier 86, and speaker 88 until audio ceases for that voice.

The decay envelope characteristics may also be obtained from the recorded pipe or other musical instrument in a manner similar to the one discussed above. An additional address line to the memory 24 would be required in order to read out the decay transient portion of the waveform. This memory address would consist of a decoding circuit requiring the occurrence of a KDR signal simultaneously with a maximum count from the voice sample address generator of generator 14 and from the voice peroid address generator 26. The decoded signal would enable memory 24 to read out the decay transient from a separate location until audio ceases.

Figure 4:
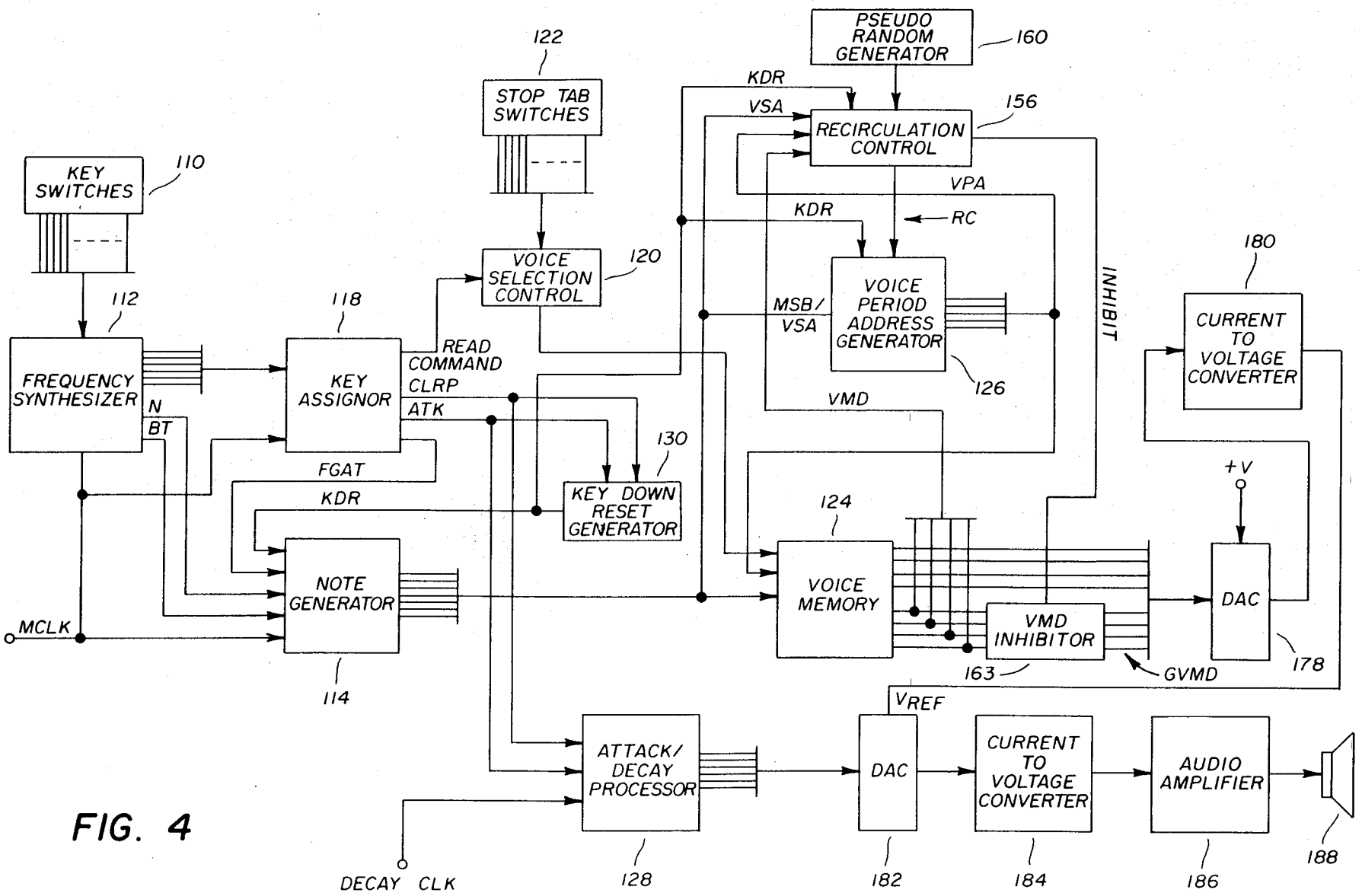
FIG. 4 is a schematic diagram, in the form of a block diagram, of an electronic musical instrument embodying an apparatus for dynamically reproducing the transient and steady state portions of the selected waveform in accordance with a second embodiment of the present invention.
Figure 5:
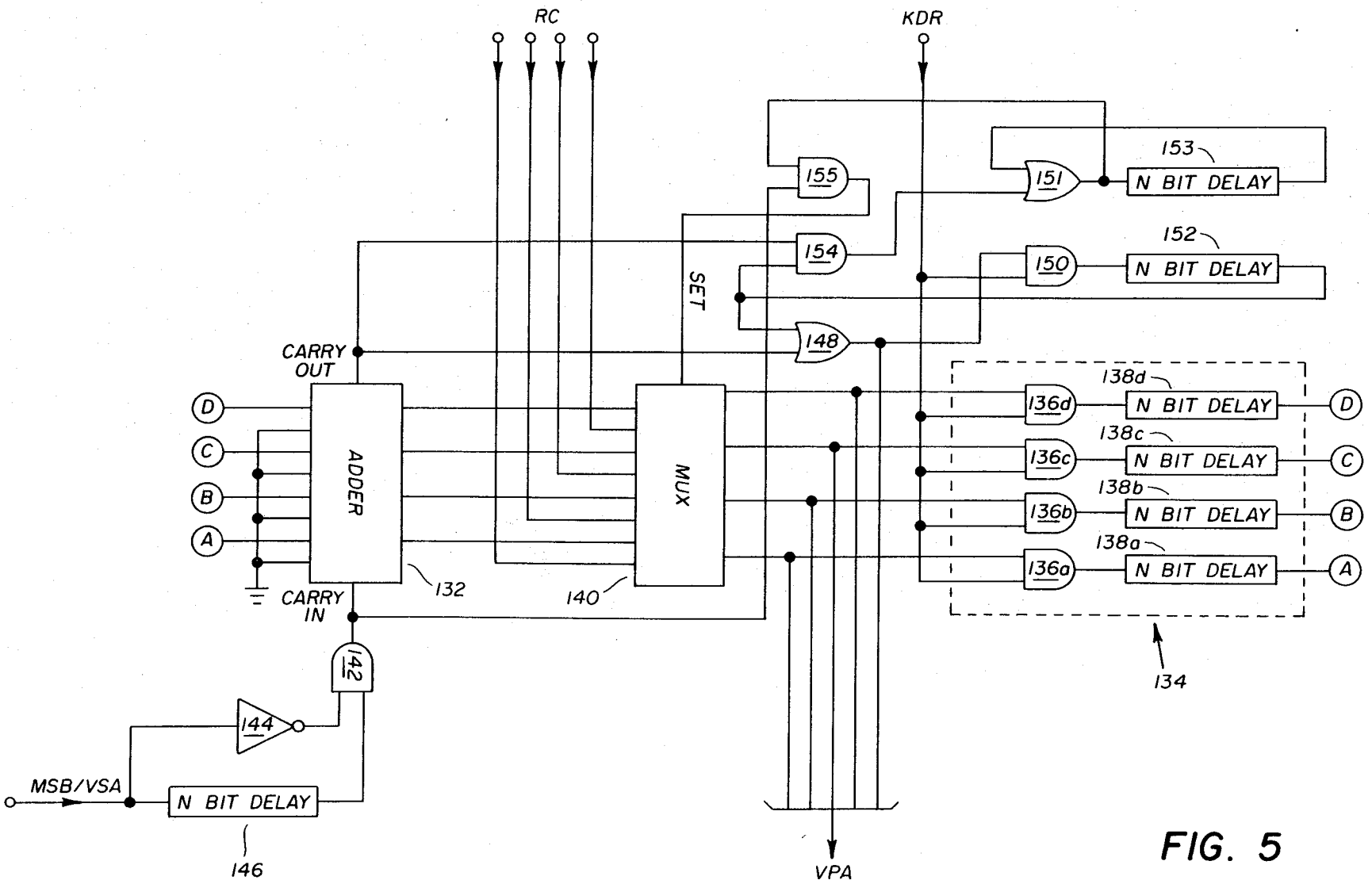
FIG. 5 is a block and logic diagram of the voice period address generator of the second embodiment of the present invention.
Figure 6:
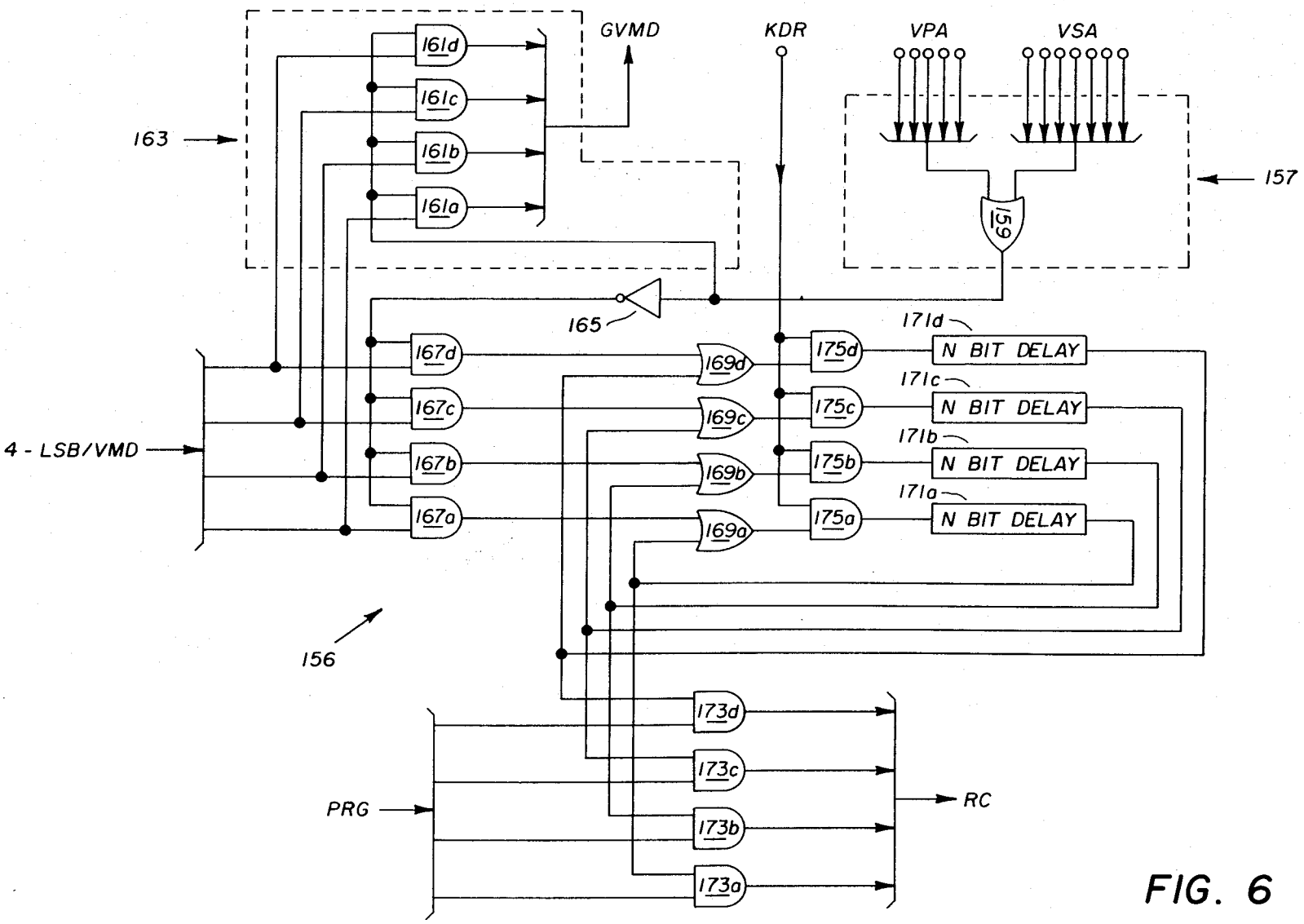
FIG. 6 is a block and logic diagram of the recirculation control and voice memory data inhibit means of the second embodiment of the present invention.

In describing the second embodiment of the present invention, reference should be made to FIGS. 4, 5 and 6. The second embodiment is quite similar to the previously described first embodiment in that it uses the same elements with the exception of a different structuring of the recirculation control 156. The reader will note that the second embodiment as shown in FIG. 4 uses the same numbering scheme with the addition of a prefix 1 to designate the different embodiment. Each element, so numbered, functions in an identical manner to that described in FIG. 1 and reference should be had to that description for the operation of the elements with the exception of the voice period address generator 126, the recirculation control 156 and the voice memory data inhibitor 163. The differences between the functioning of the first embodiment and the second embodiment will now be discussed in detail.

Referring to FIG. 5 which shows the voice period address generator 126, it is to be noted that the numbering scheme of the elements is continued as described previously adding a prefix 1 to an element which operates in similar fashion to the one described previously. The operation of the adder 132, shift register 134 and multiplexer 140 causes the identical recirculation as described above of the multiplexed addresses in accordance with the teachings of U.S. Pat. Nos. 3,610,799, 3,610,806 and 4,352,312, which are incorporated herein by reference.

The second embodiment of the invention differs from the first as follows. At the completion of the reading out of the complete waveform (voice memory data), the recirculating register formed by OR gate 151 and $1 \times n$ bit delay element 153 is set to a "1" value by the carry out signal from adder 132 as applied through AND gate 154. Since the carry out signal is caused by and is coincident with the carry signal to adder 132, the carry in signal combined with the "1" transmitted through OR gate 151 will enable AND gate 155 causing a set signal to be applied to multiplexer 140. The set signal causes the alternate inputs to multiplexer 140 to be enabled which applies the output of the recirculation control 156, RC, to the shift register 134. The value applied to the shift register 134 is based on the state of the pseudo-random generator 160 which is limited to outputting a digital code indicating one of the periods within the second half of the stored voice memory data and preferably the steady state portion of the waveform. Upon completion of the reading out from the voice memory 24 the voice memory data information for the selected period, another carry in to adder 132 will occur which will again enable the set signal to multiplexer 140 and a new preset digital code will occur on the output of multiplexer 140 in accordance with the digital code of the recirculation control 156. Thus, the counter portion of the voice period address generator 126 will begin counting from the beginning of another period within the steady state portion of the waveform. Unlike the first embodiment where, after a return to a prior period of the waveform, the voice period address generator would always count to its maximum value before a recirculation would occur again, this embodiment allows the voice period address generator to recirculate from period to period in a random fashion. This random recirculation on the occurrence of the carry in signal to adder 132 provides for only a single period to be read out from the voice memory 124 before a subsequent recirculation occurs. Thus, the latter embodiment imparts additional randomness to the resulting sound which, for the characteristics of some voices, produces a stronger wind-like quality.

In the first embodiment of the present invention the means for determining the degree or amount of recirculation during the steady state portion of the waveform was accomplished by setting the switches 58*a*–58*d* so that they connected to the output lines of the pseudo-random generator 60. In this position the switches 58*a*–58*d* were in a position to be able to create the maximum recirculation available. In the alternate position, the switches 58*a*–58*d* would permit only the final period of the waveform to be recirculated, the minimum amount. There could also be intermediate degrees of recirculation of the waveform which would be variably achieved depending upon the random combinations of the pseudo-random generator 60 and the switches 58*a*–58*d*.

The recirculation control 156, as shown in FIG. 6, allows for the degree of recirculation to be stored as a part of the voice memory data information so that when a portion of the voice memory 124, which may be incorporated into an integrated circuit such as a 2764 EPROM, is substituted for or replaced, the degree of recirculation best suited for the voice or voices contained on that integrated circuit will have been preselected and included without having to resort to changing the settings of the switches 58*a*–58*d*.

The recirculation information is preferably stored as a digital code in the first address location of the voice memory data information. A typical voice waveform which comprises the voice memory data information might require 4K bites of memory for storage. Reducing the total number of addresses by a single address for the recirculation coding will not noticeably reduce the effectiveness of the sound reproduction of the present invention. The recirculation control receives the four least significant bits of the output from the voice memory 124. These bits will contain the recirculation code from the first address location of the selected voice from memory 124.

Before describing the recirculation control in detail, the means for inhibiting the passage of the recirculation code must first be discussed. A zero decoding circuit 157 comprised of a multiple input OR gate 159 which accepts as its input the output of the voice sample address portion of note generator 114 and the the output of voice period address generator 126. When all of these address lines have a "0" value, then a "0" will appear on the output of OR gate 159 causing a "0" to appear on the input of AND gates 161*a*–161*d* which will inhibit the passage of the voice memory data, i.e., the recirculation code, through the voice memory data inhibitor 163. Once any of the inputs to OR gate 159 representing the address lines from the voice sample address portion of note generator 114 and the voice period address generator 126 changes its value to a "1", the output of OR gate 159 will also change to a "1" and permit the passage of the voice memory data through the AND gates 161*a*–161*d*. The voice memory data, which may be referred to as gated voice memory data, GVMD, will continue to be passed along until all of the inputs to OR gate 159 have again returned to an all "0" state.

The inhibit signal from the recirculation control 156, as applied to one of the inputs of AND gates 161*a*–161*d*, serves to inhibit the recirculation code from being applied to the DAC 178. Since the voice information always starts at a very low level, i.e., almost zero, the presence of a true zero, created by the voice memory data inhibitor 163 for the first amplitude sample of the waveform does not create a perceivable or objectionable sound for the listener.

Concurrently with the above described inhibit function and connected to the output of OR gate 159 is inverter 165 which is connected to one input of each of the AND gates 167*a*–167*d*. The AND gates 167*a*–167*d* will be enabled only when the AND gates 161*a*–161*d* are inhibited, and vice versa. When enabled, the AND gates 167*a*–167*d* permit the four least significant bits of the voice memory data, which in the first instance is the recirculation code to be passed to OR gates 169*a*–169*d*. The OR gates 169*a*–169*d* and 1×n bit delay elements 171*a*–171*d* form a set of recirculating storage registers where the recirculation code will be stored during the continued play of the note. The delay elements 171*a*–171*d* are preferred to be one×12 bit delay elements which will cause a recirculation delay of a number of time periods equal in number to the number of tone generator channels available in the electronic musical instrument. This is in accordance with the teachings of the aforementioned patents. The recirculation code output from the delay elements 171*a*–171*d* is applied respectively to one of the inputs of AND gates 173*a*–173*d* whose other inputs are connected to the output of the pseudo-random generator 160, PRG signal. The pseudo-random generator 160 is identical in operation to the pseudo-random generator 60 described above. The outputs of AND gates 173*a*–173*d* constitute the recirculation control signal, RC and are applied to the recirculation control inputs to the voice period address generator 126 where the appropriate desired recirculation will be accomplished.

If the key which has been held depressed is released and a new key has been selected, a new KDR signal from the key down reset generator 130 will occur and be applied to one of the inputs of AND gates 175*a*–175*d* providing a reset function to the recirculation code storage registers, delay elements 171*a*–171*d*, prior to a reloading of a potentially new recirculation code associated with the newly depressed key. Thus the recirculation code is loaded into the delay elements 171*a*–171*d* only in combination with the detection of "0" addresses from the voice sample address portion of the note generator 114 and the voice period address generator 126 and the occurrence of the key down reset signal, KDR. One must note that the KDR signal occurs at a point in time prior to a zero address count of the voice sample address generator of note generator 114, or in the case of the earlier embodiment, note generator 14.

Thus, the present invention is capable of reproducing the non-harmonic content of the waveform, which may be an organ pipe or other musical instrument or sound, by reading from its memory elements the complete attack transient portion and a number of cycles of the steady state portion of the waveform and recirculating the selected steady state portion of the waveform. The non-harmonic content is realized through the exact reproduction of the attack transient and the random recirculation of the steady state portion of the waveform. The non-harmonic content now coupled with the harmonic content of the waveform and the random recirculation of selected portions of the waveform provide the increased realism in the reproduced sound.

The present invention may be embodied in other specific forms without departing from the spirit or essential attributes thereof and, accordingly, reference should be made to the appended claims rather than to the specification as indicating the scope of the invention.

We claim:

1. In an electronic musical instrument having a greater number of selectively actuable key switches than tone generators to cause the production of sounds corresponding to the notes in a musical scale, an apparatus for reproducing the complete attack transient and steady state portions of a waveform comprising:

means for detecting the depression and release of a key switch;

means for storing a complete attack transient of a waveform and a predetermined number of full cycles of the steady state of said waveform, said waveform containing envelope characteristics and being of an harmonically and non-harmonically varying content changing with time;

means for generating addresses for selectively causing the reading from said storage means the complete attack transient of the waveform and the predetermined number of full cycles of the steady state of said waveform, and for generating addresses for selectively causing the repeated reading from said storage means, either randomly or in a predetermined pattern, a number of cycles of the steady state of said waveform until release of the depressed key switch;

means for generating addresses for selectively causing the continued repeated reading from said storage means, either randomly or in a predetermined pattern, a number of cycles of the steady state of said waveform during the decay transient of the waveform until audio ceases.

2. In an electronic musical instrument having a greater number of selectively actuable key switches than tone generators to cause the production of sounds corresponding to the notes in a musical scale, an apparatus for reproducing the complete attack transient and steady state portions of a waveform comprising:

means for detecting the depression and release of a key switch;

means for storing a complete attack transient of a waveform and a predetermined number of full cycles of the steady state of said waveform, said waveform containing envelope characteristics and being of an harmonically and non-harmonically varying content changing with time;

means for generating a set of addresses for selectively causing the reading from said storage means each cycle of the attack transient of the waveform and each cycle of the steady state of the waveform, said each cycle comprising a group of amplitude samples;

means for detecting the completion of the reading of the complete waveform and the continued depression of the key switch for selectively causing the continued reading from said storage means, either randomly or in a predetermined pattern, a number of cycles of the steady state of the waveform until release of the depressed key switch, said repeated reading of the number of cycles being a recirculation of the steady state portion of the waveform;

means for generating addresses for selectively causing the continued repeated reading from said storage means, either randomly or in a predetermined pattern, a number of cycles of the steady state of said waveform during the decay transient of the waveform until audio ceases.

3. Apparatus in accordance with claim 2 further comprising:

means for controlling the amount of recirculation of the steady state portion of the waveform by setting switch means for limiting the generated address to a predetermined address.

4. Apparatus in accordance with claim 2 further comprising:

means for controlling the amount of recirculation of the steady state portion of the waveform by setting switch means for limiting the randomly generated addresses to a predetermined range.

5. Apparatus in accordance with claim 2 further comprising:

means for controlling the amount of recirculation of the steady state portion of the waveform by incorporating in the voice memory data of the first addressed amplitude sample of the first cycle of the attack transient portion of the waveform means for limiting the randomly generated addresses to a predetermined range.

6. Apparatus in accordance with claims 1 or 2 further comprising an attack/decay processing means for generating an envelope amplitude for the waveform in response to a signal having a value indicative of attack or decay, wherein said envelope amplitude abruptly goes to full scale on the occurrence of a signal having a value indicative of attack to allow the stored attack transient of the waveform containing envelope characteristics to be read out without limitation and, on the occurrence of a signal having a value indicative of decay to control the envelope amplitude in a predetermined pattern.

7. Apparatus in accordance with claims 1 or 2 further comprising:

means for storing a complete decay transient of a waveform, said waveform containing envelope characteristics and being of an harmonically and non-harmonically varying content changing with time;

means for generating addresses for selectively causing the reading from said storage means the complete decay transient of the waveform until audio ceases.

8. In an electronic organ having a greater number of selectively actuable switches than tone generators to cause the production of sounds corresponding to the respective notes of a musical scale, an apparatus for reproducing the complete attack transient and steady state portions of a waveform comprising:

means for detecting the depression and release of a key switch;

means for storing a complete attack transient of a waveform and a predetermined number of full cycles of the steady state of said waveform, said waveform containing envelope characteristics and being of an harmonically and non-harmonically varying content changing with time;

means for generating addresses for selectively causing the reading from said storage means the complete attack transient of the waveform and the predetermined number of full cycles of the steady state of said waveform, and for generating addresses for selectively causing the repeated reading from said storage means, either randomly or in a predetermined pattern, a number of cycles of the steady state of said waveform until release of the depressed key switch;

means for generating addresses for selectively causing the continued repeated reading from said storage means, either randomly or in a predetermined pattern, a number of cycles of the steady state of said waveform during the decay transient to the waveform until audio ceases.

9. In an electronic organ having a greater number of selectively actuable switches than tone generators to cause the production of sounds corresponding to the respective notes of a musical scale, an apparatus for reproducing the complete attack transient and steady state portions of a waveform comprising:

means for detecting the depression and release of a key switch;

means for storing a complete attack transient of a waveform and a predetermined number of full cycles of the steady state of said waveform, said waveform containing envelope characteristics and being of an harmonically and non-harmonically varying content changing with time;

means for generating a set of addresses for selectively causing the reading from said storage means each cycle of the attack transient of the waveform and each cycle of the steady state of the waveform, said each cycle comprising a group of amplitude samples;

means for detecting the completion of the reading of the complete waveform and the continued depression of the key switch for selectively causing the continued reading from said storage means, either randomly or in a predetermined pattern, a number of cycles of the steady state of the waveform until release of the depressed key switch, said repeated reading of the number of cycles being a recirculation of the steady state portion of the waveform;

means for generating addresses for selectively causing the continued repeated reading from said storage means, either randomly or in a predetermined pattern, a number of cycles of the steady state of said waveform during the decay transient of the waveform until audio ceases.

10. Apparatus in accordance with claim 9 further comprising:

means for controlling the amount of recirculation of the steady state portion of the waveform by setting switch means for limiting the generated address to a predetermined address.

11. Apparatus in accordance with claim 9 further comprising:

means for controlling the amount of recirculation of the steady state portion of the waveform by setting switch means for limiting the randomly generated addresses to a predetermined range.

12. Apparatus in accordance with claim 9 further comprising:

means for controlling the amount of recirculation of the steady state portion of the waveform by incorporating in the voice memory data of the first addressed amplitude sample of the first cycle of the attack transient portion of the waveform means for limiting the randomly generated addresses to a predetermined range.

13. Apparatus in accordance with claims 8 or 9 further comprising an attack/decay processing means for generating an envelope amplitude for the waveform in response to a signal having a value indicative of attack or decay, wherein said envelope amplitude abruptly goes to full scale on the occurrence of a signal having a value indicative of attack to allow the stored attack transient of the waveform containing envelope characteristics to be read out without limitation and, on the occurrence of a signal having a value indicative of decay to control the envelope amplitude in a predetermined pattern.

14. Apparatus in accordance with claims 8 or 9 further comprising:

means for storing a complete decay transient of a waveform, said waveform containing envelope characteristics and being of an harmonically and non-harmonically varying content changing with time;

means for generating addresses for selectively causing the reading from said storage means the complete decay transient of the waveform until audio ceases.

15. In an electronic musical instrument having a greater number of selectively actuable key switches than tone generators to cause the production of sounds corresponding to the notes in a musical scale, a method for reproducing the complete attack transient and steady state portions of a waveform comprising the steps of:

detecting the depression and release of a key switch;

storing a complete attack transient of a waveform and a predetermined number of full cycles of the steady state of said waveform, said waveform containing envelope characteristics and being of an harmonically and non-harmonically varying content changing with time;

providing means for generating addresses for selectively causing the reading from said storage means the complete attack transient of the waveform and the predetermined number of full cycles of the steady state of said waveform, and for generating addresses for selectively causing the repeated reading from said storage means, either randomly or in a predetermined pattern, a number of cycles of the steady state of said waveform until release of the depressed key switch;

providing means for generating addresses for selectively causing the continued repeated reading from said storage means, either randomly or in a predetermined pattern, a number of cycles of the steady state of said waveform during the decay transient of the waveform until audio ceases.

16. In an electronic musical instrument having a greater number of selectively actuable key switches than tone generators to cause the production of sounds corresponding to the notes in a musical scale, a method for reproducing the complete attack transient and steady state portions of a waveform comprising the steps of:

detecting the depression and release of the key switch;

storing a complete attack transient of a waveform in a predetermined number of full cycles of the steady state of said waveform, said waveform containing envelope characteristics and being of an harmonically and non-harmonically varying content changing with time;

providing means for generating a set of addresses for selectively causing the reading from said storage means each cycle of the attack transient of the waveform and each cycle of the steady state of the waveform, said each cycle comprising a group of amplitude samples;

providing means for detecting the completion of the reading of the complete waveform and the continued depression of the key switch for selectively causing the continued reading from said storage means, either randomly or in a predetermined pattern, a number of cycles of the steady state of the waveform until release of the depressed key switch, said repeated reading of the number of cycles being a recirculation of the steady state portion of the waveform;

providing means for generating addresses for selectively causing the continued repeated reading from said storage means, either randomly or in a predetermined pattern, a number of cycles of the steady state of said waveform during the decay transient of the waveform until audio ceases.

17. A method in accordance with claim 16 further comprising the steps of:

controlling the amount of recirculation of the steady state portion of the waveform by setting switch means for limiting the generated address to a predetermined address.

18. A method in accordance with claim 16 further comprising the steps of:

controlling the amount of recirculation of the steady state portion of the waveform by setting switch means for limiting the randomly generated addresses to a predetermined range.

19. A method in accordance with claim 16 further comprising the steps of:

controlling the amount of recirculation of the steady state portion of the waveform by incorporating in the voice memory data of the first addressed amplitude sample of the first cycle of the attack transient portion of the waveform means for limiting the randomly generated addresses to a predetermined range.

20. A method in accordance with claims 15 or 16 further comprising the step of providing an attack-/decay processing means for generating an envelope amplitude for the waveform in response to a signal having a value indicative of attack or decay, wherein said envelope amplitude abruptly goes to full scale on the occurrence of a signal having a value indicative of attack to allow the stored attack transient of the waveform containing envelope characteristics to be read out without limitation and, on the occurrence of a signal having a value indicative of decay to control the envelope amplitude in a predetermined pattern.

21. A method in accordance with claims 15 or 16 further comprising the steps of:

storing a complete decay transient of a waveform, said waveform containing envelope characteristics and being of an harmonically and non-harmonically varying content changing with time;

generating addresses for selectively causing the reading from said storage means the complete decay transient of the waveform until audio ceases.

22. In an electronic organ having a greater number of selectively actuable switches than tone generators to cause the production of sounds corresponding to the respective notes of a musical scale, a method for reproducing the complete attack transient and steady state portions of a waveform comprising the steps of:

detecting the depression and release of a key switch;

storing a complete attack transient of a waveform and a predetermined number of full cycles of the steady state of said waveform, said waveform containing envelope characteristics and being of an harmonically and non-harmonically varying content changing with time;

providing means for generating addresses for selectively causing the reading from said storage means the complete attack transient of the waveform and the predetermined number of full cycles of the steady state of said waveform, and for generating addresses for selectively causing the repeated reading from said storage means, either randomly or in a predetermined pattern, a number of cycles of the steady state of said waveform until release of the depressed key switch;

providing means for generating addresses for selectively causing the continued repeated reading from said storage means, either randomly or in a predetermined pattern, a number of cycles of the steady state of said waveform during the decay transient of the waveform until audio ceases.

23. In an electronic organ having a greater number of selectively actuable switches than tone generators to cause the production of sounds corresponding to the respective notes of a musical scale, a method for reproducing the complete attack transient and steady state portions of a waveform comprising:

detecting the depression and release of a key switch;

storing a complete attack transient of a waveform and a predetermined number of full cycles of the steady state of said waveform, said waveform containing envelope characteristics and being of an harmonically and non-harmonically varying content changing with time;

providing means for generating a set of addresses for selectively causing the reading from said storage means each cycle of the attack transient of the waveform and each cycle of the steady state of the waveform, said each cycle comprising a group of amplitude samples;

providing means for detecting the completion of the reading of the complete waveform and the continued depression of the key switch for selectively causing the continued reading from said storage means, either randomly or in a predetermined pattern, a number of cycles of the steady state of the waveform until release of the depressed key switch, said repeated reading of the number of cycles being a recirculation of the steady state portion of the waveform;

providing means for generating addresses for selectively causing the continued repeated reading from said storage means, either randomly or in a predetermined pattern, a number of cycles of the steady state of said waveform during the decay transient of the waveform until audio ceases.

24. A method in accordance with claim 23 further comprising:

controlling the amount of recirculation of the steady state portion of the waveform by setting switch means for limiting the generated address to a predetermined address.

25. A method in accordance with claim 23 further comprising:

controlling the amount of recirculation of the steady state portion of the waveform by setting switch means for limiting the randomly generated addresses to a predetermined range.

26. A method in accordance with claim 23 further comprising:

controlling the amount of recirculation of the steady state portion of the waveform by incorporating in the voice memory data of the first addressed amplitude sample of the first cycle of the attack transient portion of the waveform means for limiting the randomly generated addresses to a predetermined range.

27. A method in accordance with claims 22 or 23 further comprising the step of providing an attack-/decay processing means for generating an envelope amplitude for the waveform in response to a signal having a value indicative of attack or decay, wherein said envelope amplitude abruptly goes to full scale on the occurrence of a signal having a value indicative of attack to allow the stored attack transient of the waveform containing envelope characteristics to be read out without limitation and, on the occurrence of a signal having a value indicative of decay to control the envelope amplitude in a predetermined pattern.

28. A method in accordance with claims 22 or 23 further comprising the steps of:

storing a complete decay transient of a waveform, said waveform containing envelope characteristics and being of an harmonically and non-harmonically varying content changing with time;

generating addresses for selectively causing the reading from said storage means the complete decay transient of the waveform until audio ceases.

* * * * *